US005699987A

United States Patent [19]

Romaneschi et al.

[11] Patent Number: 5,699,987

[45] Date of Patent: Dec. 23, 1997

[54] HOSE HANGING APPARATUS HAVING A DRAWER

[76] Inventors: Daniel J. Romaneschi, 5345 N. Fairmount Pl., Spokane, Wash. 99205; Jeff Bendio, 14712 E. Olympic Ave., Spokane, Wash. 99216

[21] Appl. No.: 687,966

[22] Filed: Jul. 29, 1996

[51] Int. Cl.[6] ..... B05B 15/06

[52] U.S. Cl. ..... 248/89; 248/75; 248/79; 137/355.16

[58] Field of Search ..... 248/75, 79, 89, 248/90; 312/213, 330.1, 333, 334.27; 137/355.12, 355.16; 206/225, 226, 389, 407, 408; 242/905

[56] References Cited

U.S. PATENT DOCUMENTS

| | | | |
|---|---|---|---|
| 419,427 | 1/1890 | Eichner, Jr. | 242/905 X |
| 1,284,022 | 11/1918 | Wright . | |
| 3,231,322 | 1/1966 | Shaw | 312/213 |
| 4,010,989 | 3/1977 | Klug | 312/333 X |
| 4,129,334 | 12/1978 | Godtschalck | 312/330.1 |
| 4,436,267 | 3/1984 | Eads et al. | 248/89 X |
| 4,588,083 | 5/1986 | Hunt | 248/79 X |
| 4,836,479 | 6/1989 | Adams | 248/89 |
| 5,046,520 | 9/1991 | Sanchez, Jr. et al. | 137/355.16 X |
| 5,056,879 | 10/1991 | Rock et al. | 312/334.27 |
| 5,238,105 | 8/1993 | Smiley | 248/79 X |
| 5,284,181 | 2/1994 | Wang | 137/355.16 X |
| 5,419,362 | 5/1995 | Blackaby | 248/89 X |

*Primary Examiner*—Alvin C. Chin-Shue
*Assistant Examiner*—Richard M. Smith
*Attorney, Agent, or Firm*—David S. Thompson

[57] ABSTRACT

A hose hanging apparatus having a drawer is disclosed. The hose hanging apparatus provides a main body supporting a front railing and a back plate having a rear railing that allows a user to coil hose about the main body between the front and back railings. A drawer is carried by the main body and provides well ventilated and drained storage for tools and supplies. The drawer provides bottom mounted riser bars that cause the drawer to elevate as it is opened, thus tending to prevent the drawer from inadvertently falling out. The riser bars tend to compensate for the drawer cavity having a smaller rear portion and a larger front portion as a result of requirements of the plastic molding process by which the main body is manufactured.

7 Claims, 6 Drawing Sheets

HOSE HANGING APPARATUS HAVING A DRAWER

CROSS-REFERENCES

There are no applications related to this application filed in this or any foreign country.

BACKGROUND

Devices designed to support a coiled hose when not in use are known. A typical known device provides a drum shaped body that is mountable on a wall. Hose is stored by winding it about the drum shaped body. An improved version of a hose hanger provides a spool shaped body that has a rim on one or both ends that tends to retain the hose. Such devices allow a user to store hose usable with water, compressed air, or other media (i.e. hydraulic fluid) in an organized manner.

Unfortunately, prior hose hangers have failed to provide an integrated compartment for storage of the implements typically used with hoses, such as nozzles, sprayers, valves, washers, sprinklers and the like. Storage for these implements is important, since they are often expensive, having been designed and manufactured to operate under pressure or in a wet environment.

As a result, what is needed is a hose hanging apparatus that supports unused hose in a coiled position, while also providing storage space for the aforementioned implements. The storage space should be lockable, drained and ventilated, since the items stored will often be both valuable and wet.

SUMMARY

The present invention is directed to an apparatus that satisfies the above needs. A novel apparatus for hanging hose is disclosed, having a drawer that provides secure, drained and ventilated storage.

A version of the hose hanging apparatus of the present invention provides:

(a) A main body having a back wall, a drawer housing, and a front railing. The drawer housing provides an upper deck having a hose support surface where a coiled hose may be stored. A front railing is supported by the front edge of the upper deck, and keeps the coiled hose in place. A back wall provides several bosses, Which allow the unit to be attached to a supporting wall or other structures by means of screws. The back wall also provides an interlocking extension having a perimeter rim, which allows connection to the back plate (below).

(b) A back plate provides an opening having a perimeter rim which engages the perimeter rim of the interlocking extension of the back wall of the main body, holding the back plate and main body together. The back plate also provides a back railing which also keeps the coiled hose in place.

(c) A drawer is carried within the main body and provides a body having a floor and a front wall having an attached handle. The floor of the drawer provides an array of holes which promotes ventilation and allows wet tools to drain. The drawer also provides a pair of riser bars which are mounted on the floor of the drawer, and reduce the chance that the drawer Will become inadvertently disengaged from the main body. The riser bars also tend to compensate for the shape of the drawer, which must be larger in front and smaller in back in order to fit into the drawer housing of the main body, which is fabricated by a molding process, and is tapered. The riser bars tend to lift the drawer upwardly as it is pulled outwardly, thereby tending to reduce the angle from the horizontal which the drawer assumes when the user releases the handle.

(d) A lock assembly is carried by the front wall of the drawer, and engages the drawer housing of the main body, thereby preventing the drawer from being inadvertently withdrawn from the hose hanger apparatus.

It is therefore a primary advantage of the present invention to provide a novel apparatus for hanging a hose that provides a drawer for storage of tools, parts, valves and sprinklers that provides holes for drainage and ventilation, and which provides segregated storage area for smaller implements in a divided front storage area within the drawer.

Another advantage of the present invention is to provide a novel apparatus for hanging hose providing a drawer having a pair of riser bars that prevent the drawer from falling out of the main body when the drawer is fully opened. The riser bars also tend to lift the drawer upwardly as it is pulled outwardly, thereby tending to reduce the angle from the horizontal which the drawer assumes when the user releases the handle. The riser bars also tend to compensate for the design of the main body, which as a result of the manufacturing process has a larger drawer opening and smaller back wall.

A still further advantage of the present invention is to provide a novel apparatus for hanging hose providing a drawer having a locking assembly that allows a user to lock the drawer in a secure manner that prevents unauthorized access to the stored implements as well as to the screws that secure the hose hanger to its supporting structure.

DRAWINGS

These and other features, aspects, and advantages of the present invention will become better understood with regard to the following description, appended claims, and accompanying drawings where:

Figure 2:
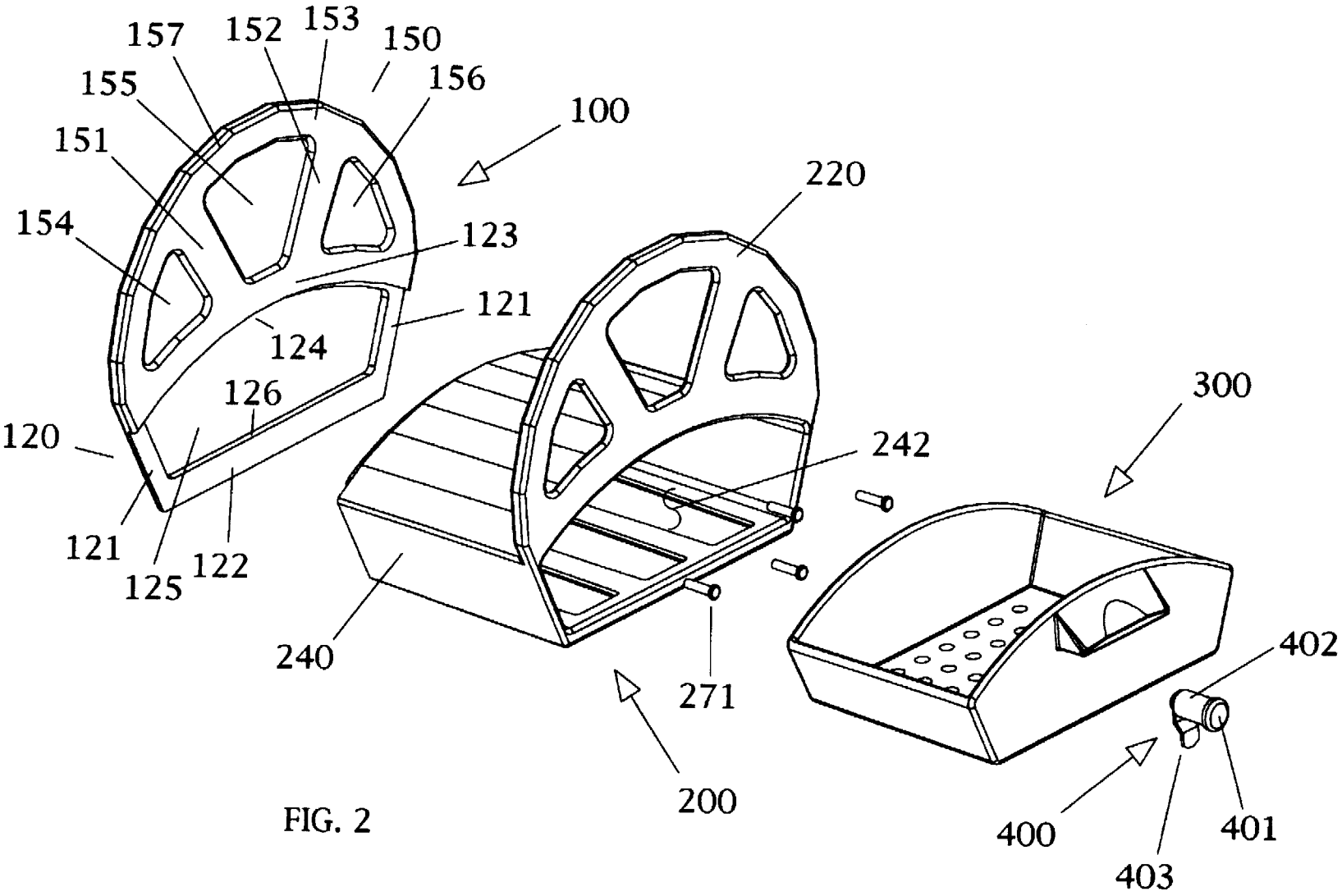
FIG. 2 is a perspective exploded view of the hose hanger of FIG. 1.
Figure 8:
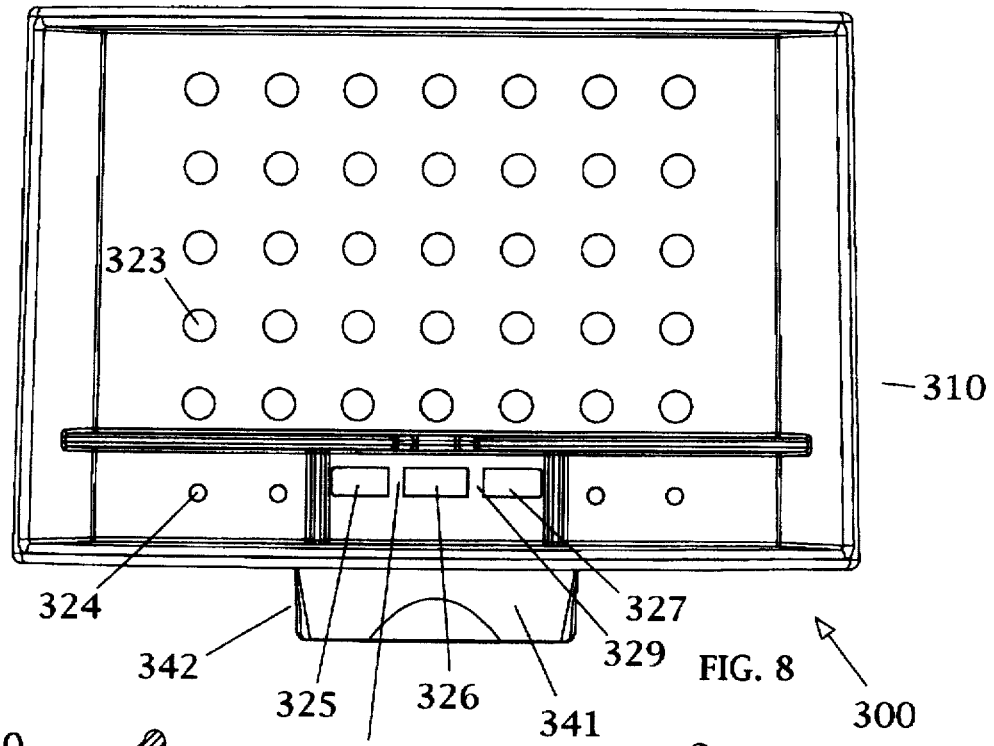
Figure 7:
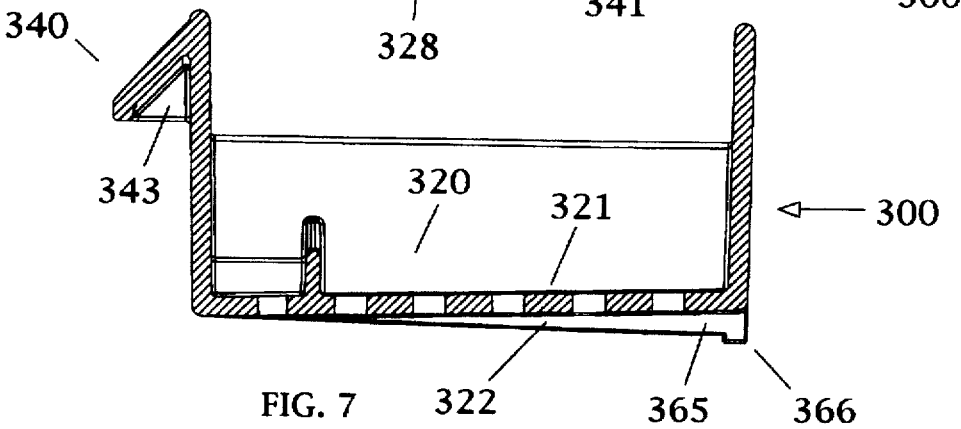
FIG. 7 is a cross-sectional view of the hose hanger of FIG. 6, taken from the 7—7 sectional view.
Figure 6:
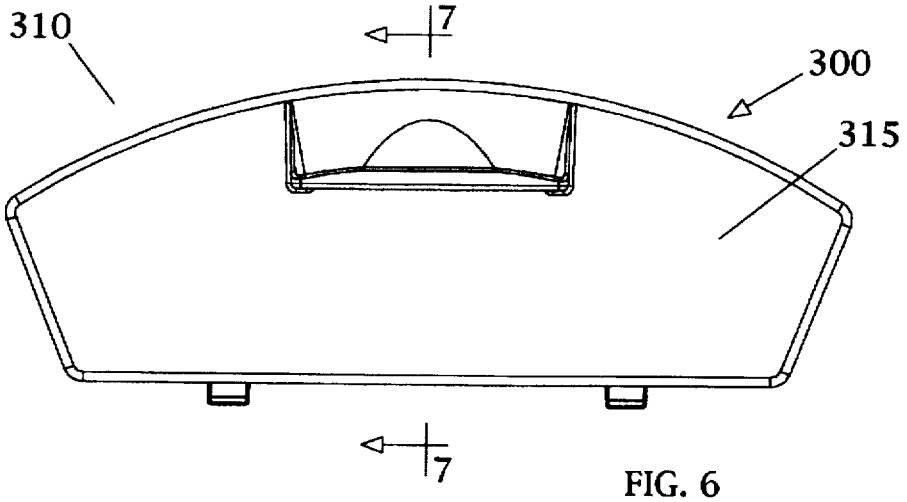
FIG. 6 is a front orthographic view of the drawer of the hose hanger of FIG. 2.
Figure 9:
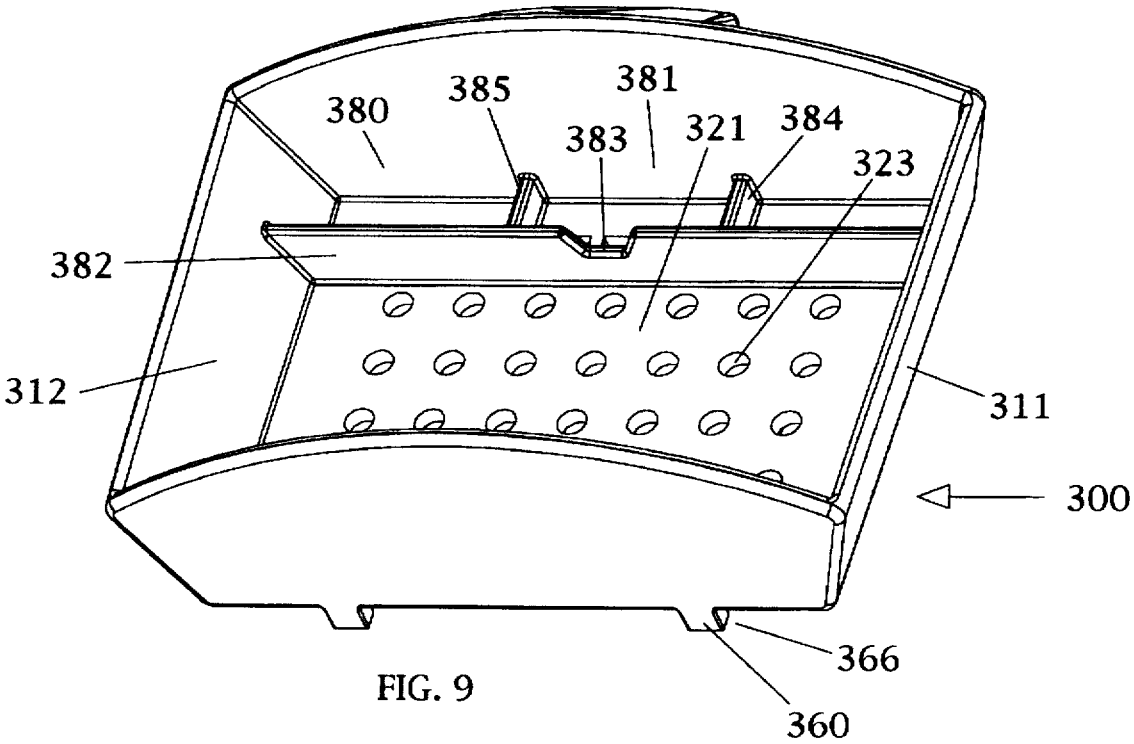
Figure 10:
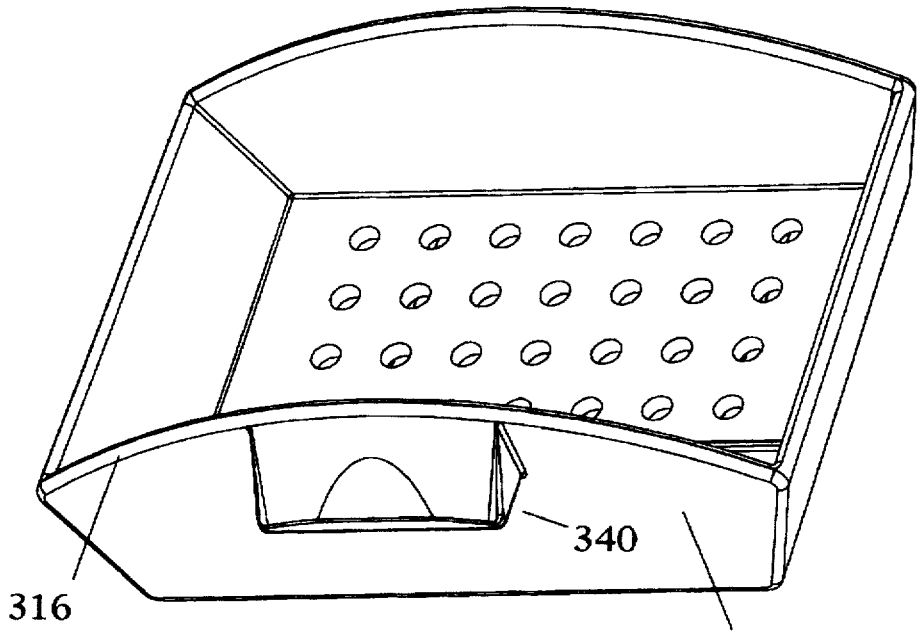
Figure 11:
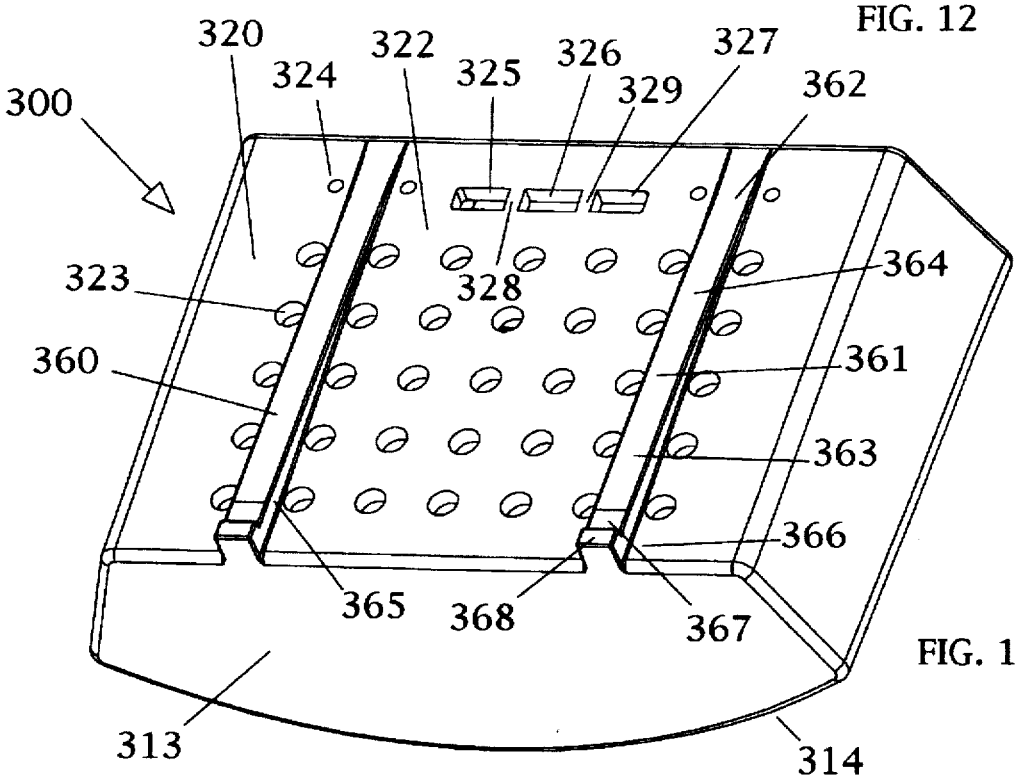

FIG. 8 a top orthographic view of the drawer of the hose hanger of FIG. 2;

FIG. 9 is a perspective view of the drawer of the hose hanger of FIG. 2;

FIG. 10 is a second perspective view of the drawer of the hose hanger of FIG. 2;

FIG. 11 is a third perspective view of the hose hanger of FIG. 2; and

Figure 12:
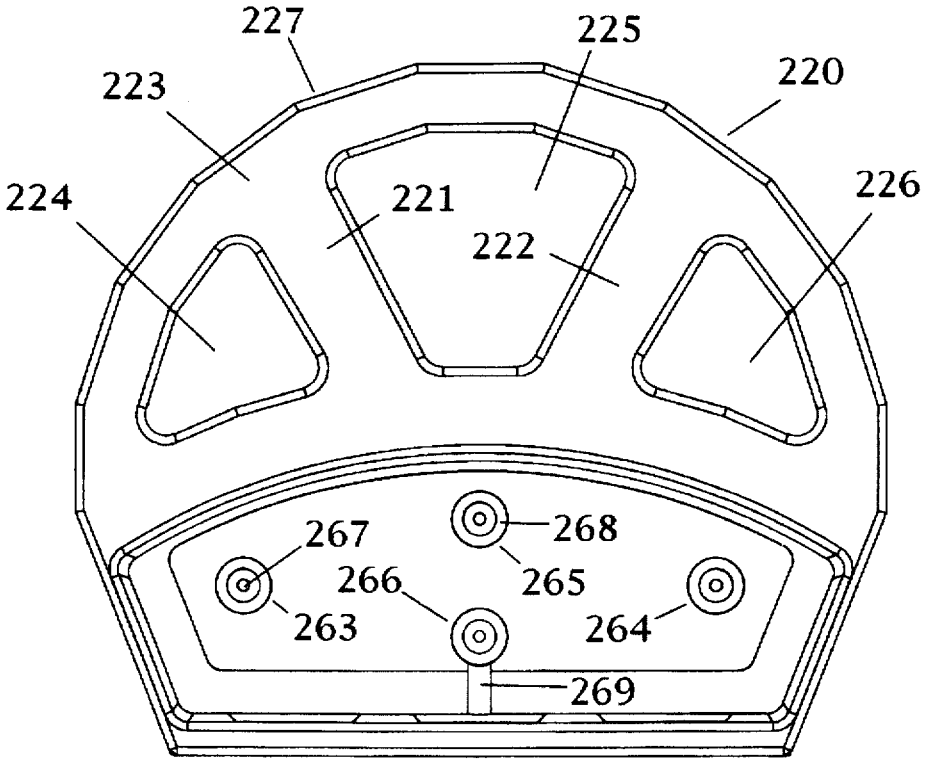

FIG. 12 is a front orthographic view of the main body of the hose hanger of FIG. 2.

DESCRIPTION

Figure 1:
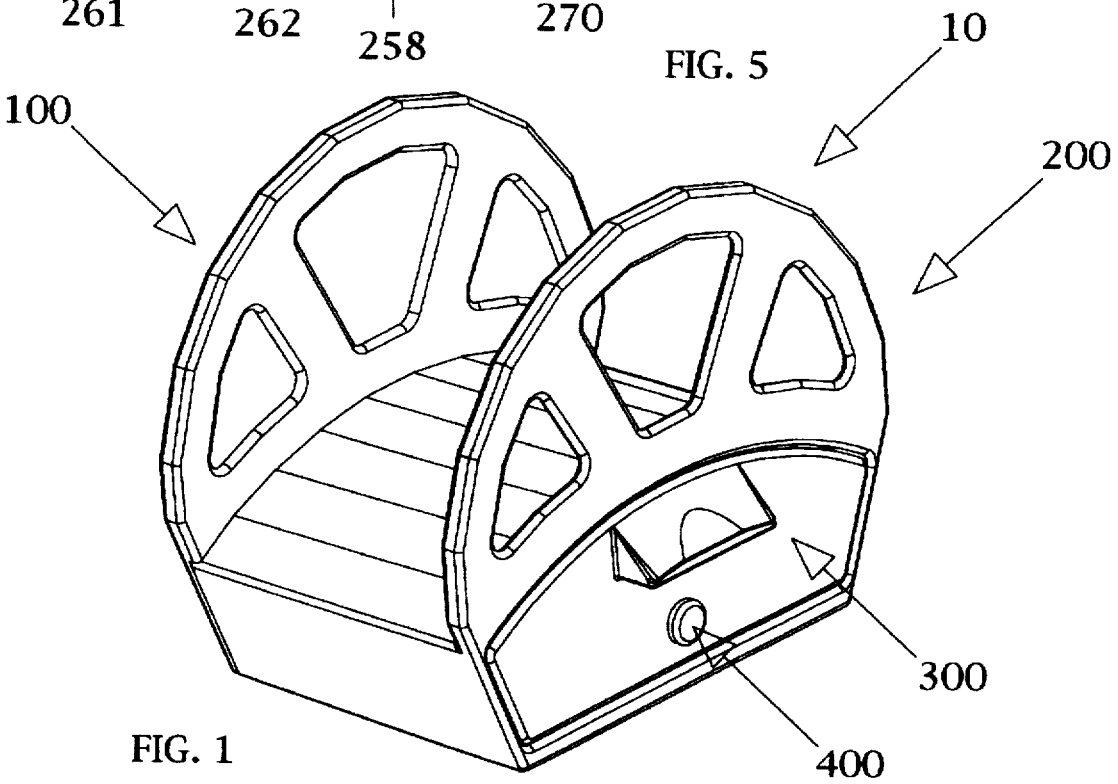
FIG. 1 is a perspective view of a version of the hose hanger of the invention.

Referring in particular to FIGS. 1 and 2, a hose hanging apparatus having a drawer constructed in accordance with the principles of the invention is seen. The hose hanging apparatus 10 is typically made from plastic by means of a molding process, but may be made of alternate materials, as desired. As seen in FIG. 2, the hose hanger of the invention provides a main body 200 which carries a back plate 100 and a drawer 300 optionally having a locking assembly 400. The back plate 100 provides a back railing 150 and an interlocking frame 120, which attaches to the body 200. The main body 200 provides a front railing 220, which together with back railing 150 supports a coiled hose, a drawer housing 240 and a back wall 260. The drawer 300 provides a body 310 having a floor 320, a small front-mounted storage area 380, and a handle 340. A pair of riser bars 360, carried by the bottom of the drawer 300, raises the drawer slightly as it is withdrawn from the drawer housing 240. This prevents the drawer from falling out of the drawer housing when fully withdrawn, and compensates for the plastic manufacturing process that allows the inner portion of the drawer housing 240 of the main body 200 to be smaller in diameter than the opening of the drawer housing.

As seen in FIG. 2, the back plate 100 is carried by the main body 200, and in use is mounted between the main body and the wall that supports the hose hanging apparatus 10. The back plate has an interlocking frame 120 which connects to the back wall 260 of the main body 200 and a back railing 150 which helps to contain hose coiled about the main body 200.

As seen in FIG. 2, the interlocking frame 120 of the back plate 100 provides left and right frame sides 121 and a frame base 122. A frame top 123 having a support shoulder 124 is curved similarly to the upper deck 245 of the drawer housing 240. An opening 125 having a perimeter rim 126 is sized to fit over the extension 261 of the back wall 260 of the main body 200.

The back railing 150 provides an upper rim 153 having reinforcing left and right supports 151, 152 defining a left opening 154, a right opening 156, and a center opening 155. The upper rim and supports have beveled edges 157.

Figure 3:
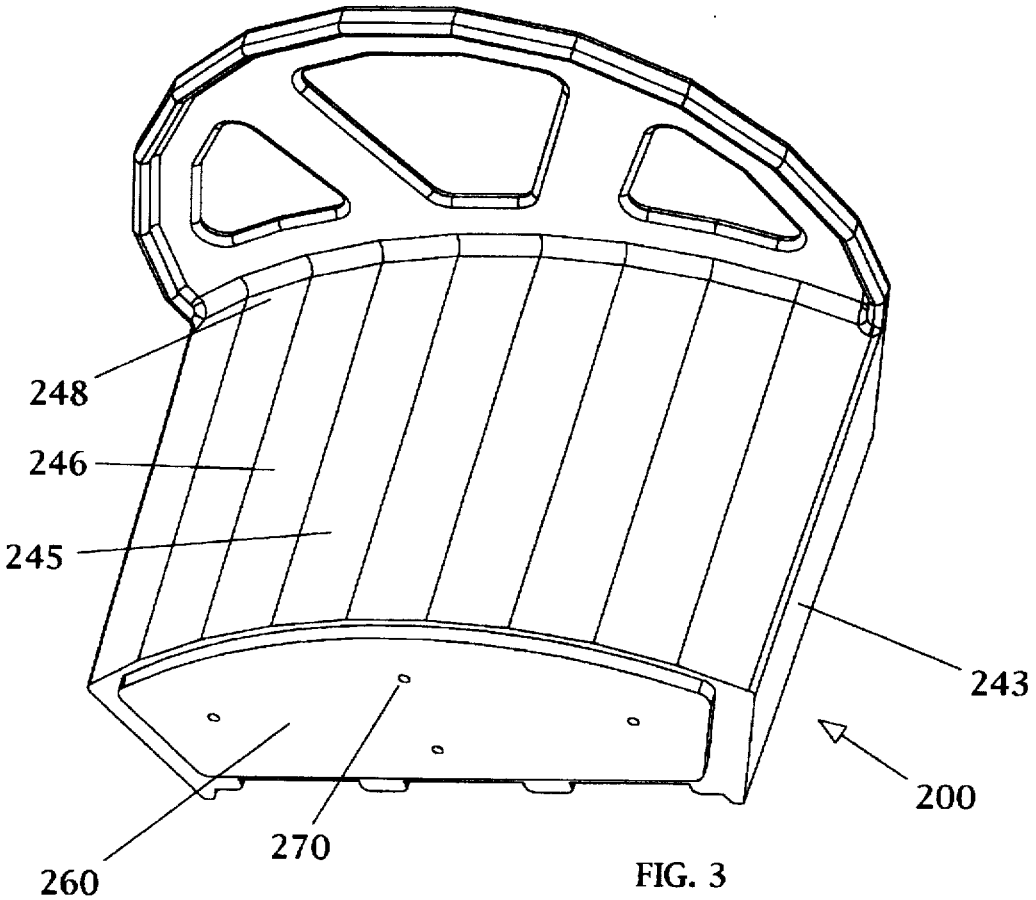
FIG. 3 is a perspective view of the main body of the hose hanger of FIG. 2.

As seen in FIGS. 2 & 3, a main body 200 provides a front railing 220 and a drawer housing 240 having a back wall 260. The front railing retains hose that has been coiled about the main body. The back wall provides attachment means for supporting the hose hanging apparatus 10 from a wall or other structure, and also provides a stop for the drawer 300.

Figure 4:
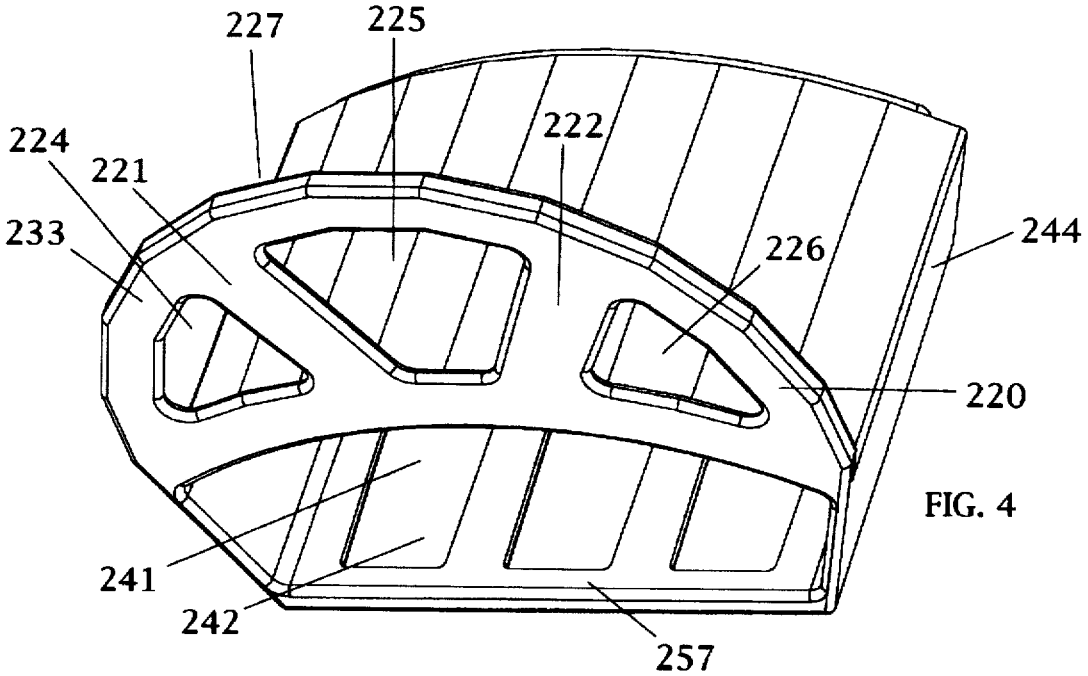
FIG. 4 is a second perspective view of the main body of the hose hanger of FIG. 2.

As seen in FIG. 4, the front railing 220 provides an upper rim 223 having left and right supports 221, 222 defining a left opening 224, a right opening 226, and a center opening 225. The upper rim and supports have beveled edges 227.

Figure 5:
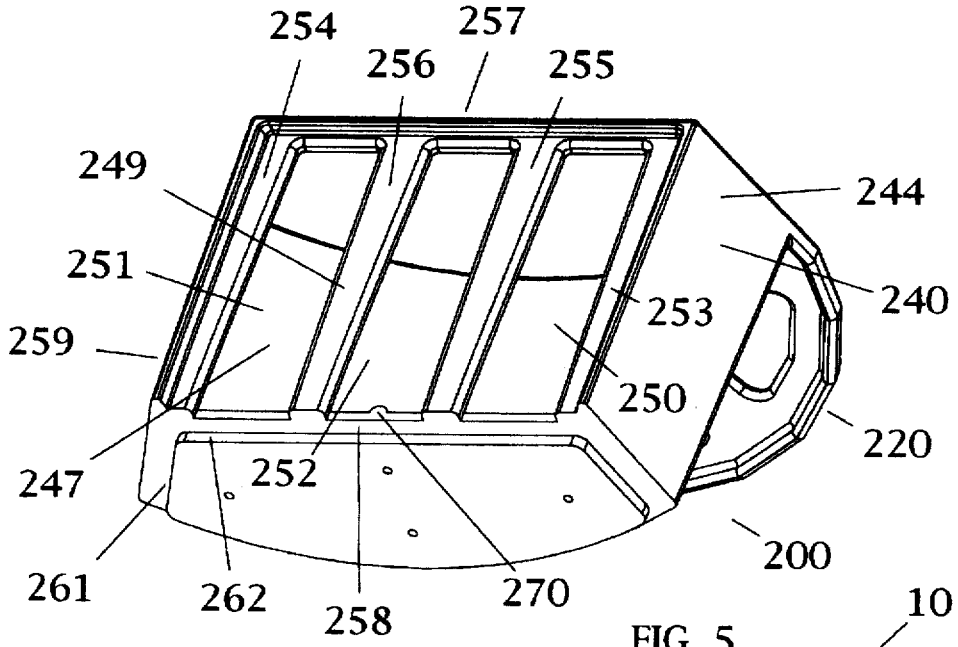
FIG. 5 is a third perspective view of the main body of the hose hanger of FIG. 2.

As seen in FIGS. 2, to 4, the drawer housing 240 provides a drawer cavity 241 having an opening 242. As a result of the need to pull the main body 200 out of a plastic molding device during its manufacture, the area of the opening 242 is larger than the area of the back wall 260. As seen in FIGS. 3–5, the sloping left and dght sides 243, 244 connect the upper deck 245 with the bottom surface 249. The upper deck 245 has an upper hose support surface 246, as seen in FIGS. 3 and 4, and a lower surface 247, as seen in FIG. 5, that is the ceiling of the drawer cavity 241. As seen in FIG. 3, a front edge 248 of the upper deck 245 supports the front railing 220.

Referring to FIGS. 4 and 5, the bottom surface 249 of the drawer housing 240 is seen. The bottom surface functions to support the drawer 300, which slides within the drawer cavity 241. The bottom surface 249 provides a left edge support 253, a right edge support 254, a left support 255 and a right support 256, which define a left opening 250, a right opening 251, and a center opening 252. The bottom surface is made more rigid by a front cross bar 257 and a rear cross bar 258. A three sided rim 259 provides additional strength, but adds little weight.

The back wall 260 is best seen in FIGS. 3 and 5. The back wall provides an extension 261 having a rim 262, which is sized to fit snugly into the opening 125 in the interlocking frame 120. As seen in FIG. 12, left and right mounting bosses 263, 264, together with center upper and lower mounting bosses 265, 266 allow the back wall 260 to be attached by screws 271 or other fasteners, as seen in FIG. 2, to any appropriate vertical surface. Each mounting boss provides a hole 267 through which a screw may be inserted, and a rim 268 that functions as a stop for the drawer 300 as it slides within the drawer housing 240. The mounting bosses tend to reinforce the back wall, and prevent damage due to stress near the screw holes 267. As seen in FIGS. 5 and 12, a boss 269 having a half-round lower surface 270, allows a user to install a downwardly directed hook having a threaded screw upper portion. Such a hook would be useful to a user desiring to hang tools or articles such as an over-sized sprinkler that would not fit easily in the drawer, or would provide storage in addition to the drawer.

As seen in FIGS. 2 and 6 through 11, a drawer 300 slides within drawer cavity 241. The drawer provides a body 310 having a small front-mounted storage area 380, a floor 320, and a handle 340. As seen in FIG. 11, riser bars 360 elevate the drawer as it is withdrawn from the drawer cavity 241.

The body 310 of the drawer 300 provides left and right side walls 311, 312, and a back wall 313 having a curved upper rim 314. A front wall 315 is slightly larger than the back wall, due to the construction methods of the main body 200, which results in a drawer cavity 241 having a larger front opening 242 than back wall 260. The front wall 315 provides a curved upper rim 316 and supports a handle 340, having a front 341, two sides 342, and a cavity 343 which provides a user with a convenient grip.

The floor 320 of the drawer 300 provides an upper surface 321 and a lower surface 322. Round holes 323 are provided over most of the floor surface; however smaller round holes 324 are provided in the area of the small front-mounted storage area 380. Holes 323, 324 provide both drainage and ventilation for the drawer. Left, center and right rectangular slots 325, 326, 327 separated by left and right cross bars 328, 329, allow for additional ventilation and drainage. If needed, the cross bars 328, 329 may be detached and removed, allowing room for movement by the catch mechanism 403 of the lock mechanism 400.

As seen in FIG. 11, left and right riser bars 360 having wedge-shaped bodies 361 are carried by the floor 320 of the drawer 300. The riser bars 360 tend to elevate the drawer as it is withdrawn, and thereby tend to maintain the support of the drawer by the drawer housing, preventing the drawer from becoming dislodged. When the drawer is pushed inwardly, to the closed position, the riser bars 360 travel in the left and right openings 250, 251 of the bottom surface 249 of the drawer housing 240. Each riser bar 360 has a wedge-shaped body 361 having a front portion 362 and a rear portion 363. A lower surface 364 is seen in FIG. 11, and slides on the front cross bar 257 when the drawer is withdrawn. A generally triangular side surface 365 is seen in both FIGS. 8 and 11. A stop 366 prevents the drawer from inadvertently falling out of the drawer housing. The stop 366 provides a recessed catch point 367 and a protruding stop block 368.

A small front storage area 380 allows a user to store small items in a ventilated and drained area, apart from the storage area used for larger items. The storage area provides left, center, and right storage compartments 381. A side-to-side wall 382 divides the small storage section from the larger storage section. As seen in FIG. 9, a notch 383 is provided in wall 382, which allows a user to conveniently use a screwdriver to install the lock assembly 400. Left and right front-to-wall dividers 384, 385 serve to subdivide the small front storage area 380 for more convenient use.

A lock assembly 400 comprising a key hole face plate 401, a cylinder lock mechanism 402, and a catch mechanism 403 may optionally be installed by the user. When the lock mechanism 400 is to be installed, the left and right cross bars 328, 329 should be removed, so that the catch mechanism may catch on the front cross bar 257 of the drawer housing 240 when in the lowered and locked position.

To use the hose hanging apparatus 10 of the invention, the user first inserts the extension 261 of the back wall 260 of the main body 200 into the opening 125 of the back plate 100. If desired, a hook having a threaded end may have been screwed into surface 270 of the boss 269. The back wall 260 is then positioned where it is to be mounted, and screws 271 or other fasteners are used to connect the back wall to a supporting vertical wall or other surface. If desired, a locking assembly is installed on the drawer, which is then inserted, and the cross bars 328, 329 removed. Garden water hose, air hose associated with compressors, or hydraulic hose may then be coiled about the main body of the hose hanging apparatus. The front railing 220 and the back railing 150 serve to keep the hose in place. Tools, implements and supplies may then be stored in the drawer, as desired.

The previously described versions of the present invention have many advantages, including the primary advantage of a novel apparatus for hanging a hose having a drawer for storage of tools, parts, valves and sprinklers that provides holes for drainage and ventilation, and which provides segregated storage area for smaller implements in a divided small front storage area.

A further advantage of the present invention is to provide a novel apparatus for hanging hose providing a drawer having a pair of riser bars that prevent the drawer from falling out of the main body when the drawer is fully opened. The riser bars also tend to lift the drawer upwardly as it is pulled outwardly, thereby tending to reduce the angle from the horizontal which the drawer assumes when the user releases the handle.

A still further advantage of the present invention is to provide a novel apparatus for hanging hose providing a drawer having a locking assembly that allows a user to lock the drawer in a secure manner that prevents unauthorized access to the stored implements as well as to the screws that secure the hose hanger to its supporting structure.

Although the present invention has been described in considerable detail and with reference to certain preferred versions, other versions are possible. For example, an alternative version of the invention may combine the main body and the back plate into a unitary component. Alternatively, the back plate may be deleted altogether for a more economical product. Similarly, the locking assembly is optional. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A hose hanging apparatus, comprising:

(a) a main body comprising:

(a) a drawer housing, having a front opening, comprising:

(a) an upper deck having a hose support surface having a front edge;

(b) a left side, attached to the upper deck;

(c) a right side, attached to the upper deck; and (d) a bottom surface, defining at least one ventilating opening, attached to the left side and the right side;

(b) a front railing, carried by the front edge of the upper deck; and (c) a back wall, smaller in size than the front opening, comprising means for attaching the back wall to a vertical support surface; and (b) a drawer, slidably carried by the drawer housing, comprising:

(a) a floor, having a sloping lower surface defining at least one drain hole;

(b) a front wall, connected to the floor; and (c) a handle, attached to the front wall.

2. The hose hanging apparatus of claim 1, additionally comprising horizontally oriented riser bar means, carried by the drawer, for elevating the drawer as it is withdrawn from the drawer housing.

3. The hose hanging apparatus of claim 1, wherein the drawer further comprises at least one riser bar, having a wedge-shaped body, comprising:

(a) a horizontally oriented lower surface, slidably carried by the bottom surface of the drawer housing; and (b) a triangular side surface adjacent to the lower surface.

4. The hose hanging apparatus of claim 3, wherein the riser bar additionally comprises stop means, carried by the wedge-shaped body, for preventing the drawer from falling out of the drawer housing of the main body, comprising:

(a) a recessed catch point; and (b) an extended stop block.

5. A hose hanging apparatus, comprising:

(a) a main body, comprising:

(a) a drawer housing, having a front opening, comprising:

(a) an upper deck having a hose support surface having a front edge;

(b) a left side, attached to the upper deck;

(c) a right side, attached to the upper deck; and (d) a bottom surface, having at least one opening, attached to the left side and the right side;

(b) a front railing, carried by the front edge of the upper deck; and (c) a back wall, smaller in size than the front opening, comprising:

(a) means for attaching the back wall to a vertical support surface; and (b) an interlocking extension, carried by the back wall;

(b) a back plate, carried by the main body, comprising:

(a) interlocking frame means for connecting to the main body, comprising:

(a) a support shoulder, carried by the upper deck; and (b) a peripheral rim defining an opening sized to carry the interlocking extension of the back wall;

(b) a back railing, connected to the interlocking frame means; and (c) a drawer, slidably carried by the drawer housing, comprising:

(a) a floor, having a sloping lower surface defining at least one drain hole;

(b) a front wall, connected to the floor;

(c) a handle, attached to the front wall; and (d) at least one riser bar, carried by the lower surface of the floor of the drawer, comprising:

(a) a wedge-shaped body comprising:

(a) a horizontally oriented lower surface, slidably carried by the bottom surface of the drawer housing, having a rear portion; and (b) a triangular side surface, adjacent to the lower surface; and (b) stop means, carded by the wedge-shaped body, for preventing the drawer from falling out of the drawer housing of the main body, comprising:

(a) a recessed catch point in the rear portion of the lower surface; and (b) a stop block extending from the rear portion of the wedge-shaped body.

6. The hose hanging apparatus of claim 5, additionally comprising locking means, carried by the drawer and by the drawer housing, for locking the drawer within the drawer housing.

7. The hose hanging apparatus of claim 6, additionally comprising a small front storage area defined within the drawer having left, center and right compartments.

* * * * *